US006732554B2

(12) United States Patent
Lamprecht et al.

(10) Patent No.: US 6,732,554 B2
(45) Date of Patent: May 11, 2004

(54) ADAPTER FOR FASTENING WATER LEVEL REGULATORS

(75) Inventors: Michael Lamprecht, Berlin (DE); Wolfgang Mücke, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/457,743

(22) Filed: Jun. 9, 2003

(65) Prior Publication Data

US 2003/0213272 A1 Nov. 20, 2003

Related U.S. Application Data

(63) Continuation of application No. PCT/EP01/13759, filed on Nov. 26, 2001.

(30) Foreign Application Priority Data

Dec. 8, 2000 (DE) ..... 100 61 238

(51) Int. Cl.[7] ..... D06F 39/08; D06F 39/12
(52) U.S. Cl. ..... 68/212
(58) Field of Search ..... 68/12.19, 12.21, 68/207, 212; 73/290 R

(56) References Cited

U.S. PATENT DOCUMENTS 4,080,828 A * 3/1978 Akita et al. ..... 73/308
4,696,171 A * 9/1987 Babuin ..... 68/207

FOREIGN PATENT DOCUMENTS

| | | | |
|---|---|---|---|
| DE | 82 18 877.7 | 10/1982 | |
| DE | 4231849 A1 * | 6/1993 | ..... A47L/15/42 |
| GB | 2 123 148 A | 1/1984 | |

* cited by examiner

*Primary Examiner*—Frankie L. Stinson
*Assistant Examiner*—Joseph L. Perrin
(74) *Attorney, Agent, or Firm*—Laurence A. Greenberg; Werner H. Stemer; Ralph E. Locher

(57) ABSTRACT

For fastening water level regulators on parts of washing machines, an adapter including a housing having first and second portions each for accommodating a water level regulator, a fastening device for fastening the adapter on parts of a washing machine, and two openings in the accommodating portions for accommodating a fastening device disposed on the respective water level regulator. The fastening device of the adapter is disposed in a central portion of the housing, the first accommodating portion is disposed in a first side portion, and the second accommodating portion is disposed in a second side portion, the central portion being bounded by the two side portions. The opening in the first accommodating portion is disposed substantially perpendicularly to the opening in the second accommodating portion.

14 Claims, 2 Drawing Sheets

ADAPTER FOR FASTENING WATER LEVEL REGULATORS

CROSS-REFERENCE TO RELATED APPLICATION

This application is a continuation of copending International Application No. PCT/EP01/13759, filed Nov. 26, 2001, which designated the United States and was not published in English.

BACKGROUND OF THE INVENTION

Field of the Invention

The invention relates to an adapter for fastening water level regulators on parts of washing machines.

Water level regulators are used in household appliances, for example, washing machines, for regulating the filling level of the washing machine in an electronically controlled manner. Such an analog or digital water level regulator is accommodated and fixed on the washing machine here, for example, by virtue of a latching-in device that is disposed on the water level regulator being latched into a suitable opening on plastic or metal parts of the washing machine, for example, on cable ducts. Up until now, it has only been possible for in each case one water level regulator to be clamped firmly on the washing machine by a fastening device, with the result that, in the case of two or more water level regulators being used, it has been necessary to make a number of patterns of holes in the part that is envisaged for accommodating the fastening device for the water level regulators. The resulting alterations to parts lead to considerable development and tool costs and, in addition, the space available is often not sufficient for accommodating a plurality of individually inserted water level regulators.

SUMMARY OF THE INVENTION

It is accordingly an object of the invention to provide an adapter for fastening water level regulators that overcomes the hereinafore-mentioned disadvantages of the heretofore-known devices of this general type and that is intended for fastening water level regulators on parts of washing machines and allows a plurality of water level regulators to be fastened on a part of the washing machine without the part having to be altered and that, at the same time, saves a considerable amount of space.

With the foregoing and other objects in view, there is provided, in accordance with the invention, the adapter has a housing, which has a first portion and a second portion, each for accommodating a water level regulator, a fastening device for fastening the adapter on parts of the washing machine, and two openings in the accommodating portions of the housing for accommodating a fastening device disposed on the respective water level regulator. The fastening device of the adapter is disposed on a central portion of the housing, the first accommodating portion is disposed in a first side portion and the second accommodating portion is disposed in a second side portion, the central portion being bounded by the two side portions. The opening in the first accommodating portion is disposed substantially perpendicularly to the opening in the second accommodating portion. Such a configuration ensures that a plurality of water level regulators can be fastened on parts of the washing machine through just one fastening device, the amount of space required for the water level regulator is being kept to a minimum and no additional machining costs being incurred.

In accordance with another feature of the invention, the fastening device is, advantageously, disposed such that the movement direction for clamping the adapter firmly is substantially the same as the movement direction for clamping a water level regulator firmly in the first accommodating portion. As a result, the space taken up in the lateral direction is minimized.

In accordance with a further feature of the invention, because at least the opening in the first accommodating portion extends more or less over the entire height of the latter, it being wider in the direction of the top end of the accommodating portion than in the direction of the bottom end, such a configuration advantageously results in a fastening mechanism that can be released again particularly easily and is, thus, extremely suitable for exchanging water level regulators.

In accordance with an added feature of the invention, it is also advantageous for at least the first accommodating portion, at a small distance behind the opening, to have a resilient tongue that is fastened at a top end of the accommodating portion, this ensuring that the water level-regulator fastening device introduced is guided in a precise manner and the water level regulator, once inserted, is additionally secured in position with latching action.

In accordance with an additional feature of the invention, at least the second accommodating portion, on its outer borders, advantageously has guide webs by which the water level regulator, once introduced, is fixed in position.

In accordance with yet another feature of the invention, the central housing portion, advantageously, has a cavity for accommodating the fastening device of a water level regulator that is introduced through the opening of the second accommodating portion. Such a configuration results in a considerable amount of space being saved in the lateral direction.

In accordance with a concomitant feature of the invention, it is advantageous for the housing to be formed in one piece because such a configuration reduces the assembly outlay.

Other features that are considered as characteristic for the invention are set forth in the appended claims.

Although the invention is illustrated and described herein as embodied in an adapter for fastening water level regulators, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
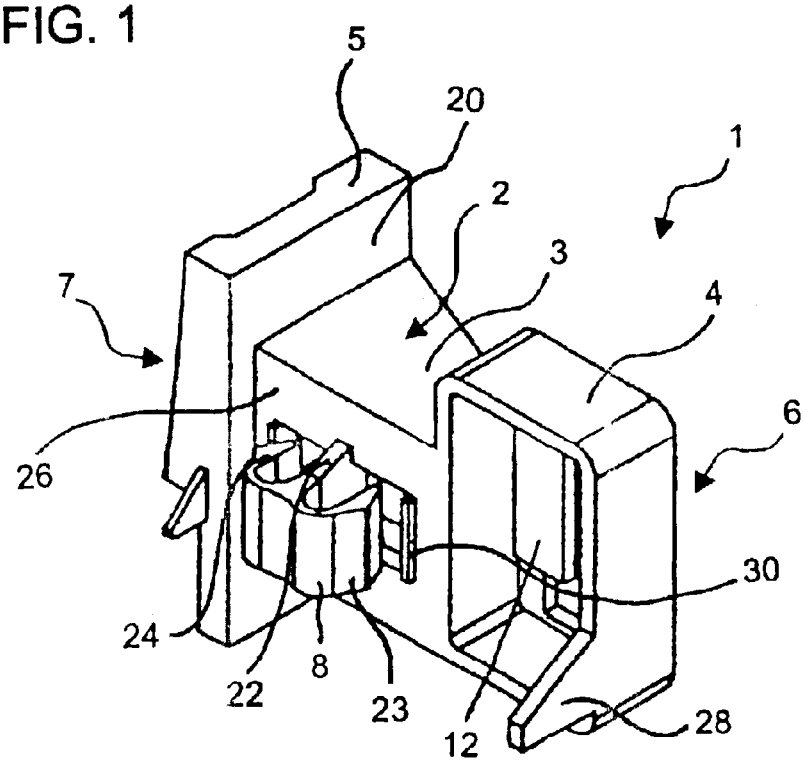
FIG. 1 is a perspective view of a preferred embodiment of an adapter according to the invention as seen rearwardly from above.
Figure 2:
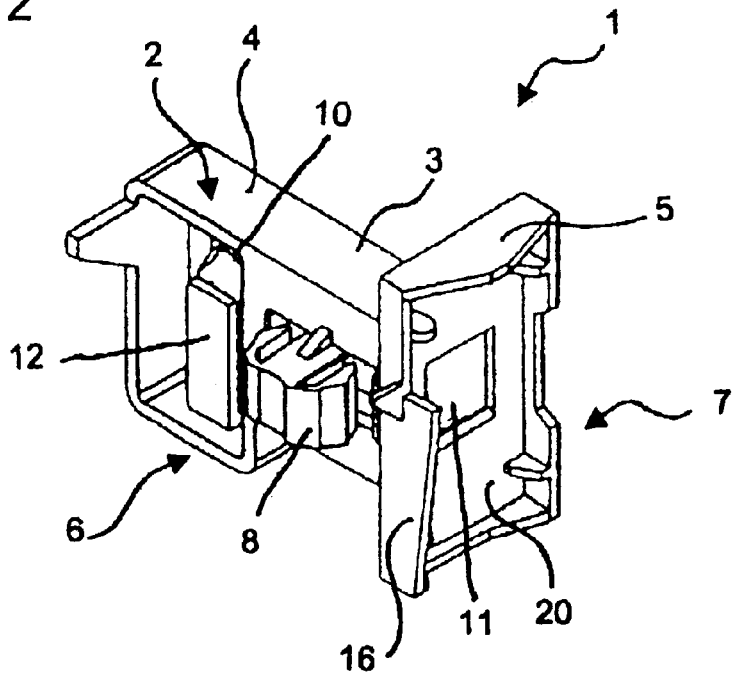
FIG. 2 is a perspective view of the adapter of FIG. 1 as seen rearwardly from below.

Referring now to the figures of the drawings in detail and first, particularly to FIGS. 1 and 2 thereof, there is shown a preferred embodiment of the adapter according to the invention for fastening water level regulators on parts of the washing machine. The adapter 1 has a housing 2, which includes a central portion 3, a first side portion 4, and a second side portion 5. In the preferred embodiment, the three portions 3, 4, 5 of the housing 2 are formed in one piece, preferably, from plastic. The central portion 3 is located between the two side portions 4, 5 and is shaped in a manner similar to a truncated pyramid that widens from the first side portion 4 in the direction of the second side portion 5. The rear boundary surface 26 of the central housing portion 3 forms a planar surface with the rear end of the first side portion 4, while the front boundary surface 27 of the central housing portion 3 (see FIG. 4) is disposed obliquely in relation to the rear surface 26.

The first side portion 4 has a first accommodating portion 6, which serves for accommodating a fastening device disposed on a water level regulator. The second side portion 5, likewise, has a second accommodating portion 7, which, although configured differently to the first accommodating portion 6, likewise serves for accommodating a fastening device disposed on a water level regulator.

Figure 3:
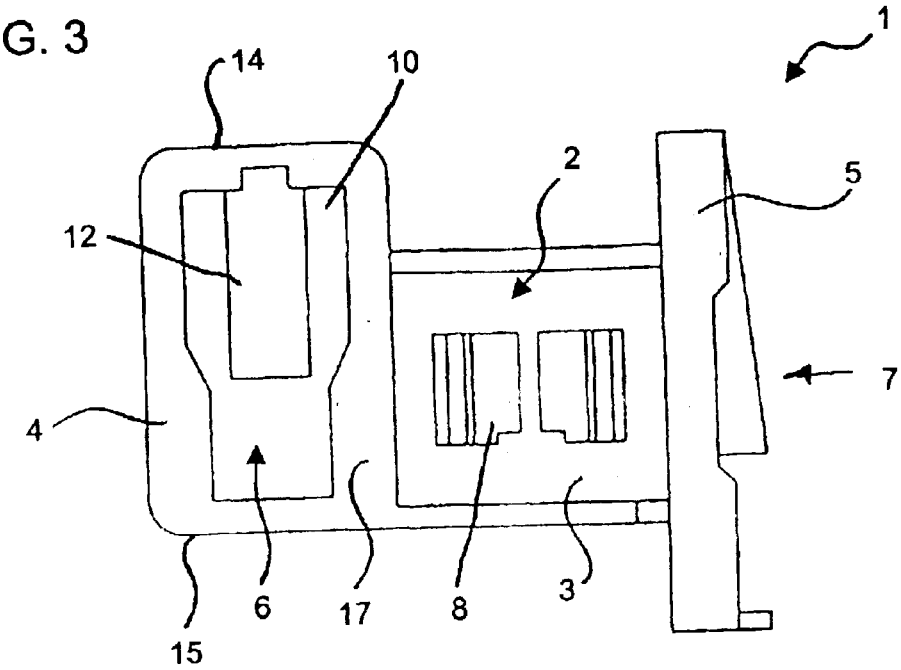
FIG. 3 is an elevational view of the front side of the adapter of FIG. 1 opposite the side shown in FIG. 1.

The first side portion 4 is of substantially hollow-cuboidal configuration and has, on a front side thereof, a surface 17 that can be seen from FIG. 3, is disposed parallel to the rear surface 26 of the central housing portion 3 and has an opening 10 for accommodating the fastening device for a non-illustrated water level regulator. The opening 10 extends more or less over the entire height of the first side portion 4 and is wider in the direction of the top end 14 than in the direction of the bottom end 15. Disposed at a small distance behind the opening 10 is a vertically running resilient tongue 12 that extend from the top end 14 of the first side portion 4, preferably, as far as the level of the narrowing of the opening 10. For material-saving reasons, the rear side of the first side portion 4 can remain open.

The second side portion 5 is disposed perpendicularly to the first side portion 4 and has a surface 20 that forms the base surface of the pyramidal central housing portion 3 but, at the same time, extends beyond the same in the upward, downward and rearward directions. The surface 20 is of the same width as the surface 17 of the first side portion 4, but extends further downward in the lengthwise direction. Bounding guide webs 16 extend outward on the borders of the surface 20, perpendicularly to the surface 20. The surface 20 contains an opening 11 that is approximately rectangular and is smaller than the opening 10 in the first side portion 4. The central housing portion 3 is of hollow configuration. As a result, the opening 11 can be used for accommodating a standardized water level regulator fastening device, which will be described in more detail below, and is, then, in a state in which it is clamped firmly within the central housing portion 3.

A standardized fastening device 8 of this type is, likewise, disposed on the rear surface 26 of the central housing portion 3. This fastening device 8 is of anchor-like configuration and has a central web 22 and two hooks 23 and 24 disposed to the sides of the central web 22. The fastening device 8 is formed from flexible plastic. As a result, the free ends of the two hooks 23, 24 can be bent in the direction of the web 22. For stabilizing and centering purposes, two vertically running webs 30 are provided at the sides of the hooks to engage with corresponding slots in the washing-machine part.

First of all, the two water level regulators are clamped into the two accommodating portions by their standardized fastening devices. In the second side portion 5, the water level regulator is inserted between the guide webs 16 from the side. As a result, the fastening device is pressed through the opening 11 into the cavity at the central housing portion 3 and latches on the surface 20 from the inside. The fastening device of the other water level regulator is introduced into the first side portion 4 at the top end of the opening 10 and is supported in the rearward direction by the resilient tongue 12. The fastening device is, then, displaced downward in its entirety and is clamped firmly, by way of the hooks, on the surface 17 from the inside because the opening 10 is narrower than the distance between the hooks of the fastening device. The resilient tongue 12 springs back into its starting position and, thus, serves as additional latching-action securing measures from above.

Figure 4:
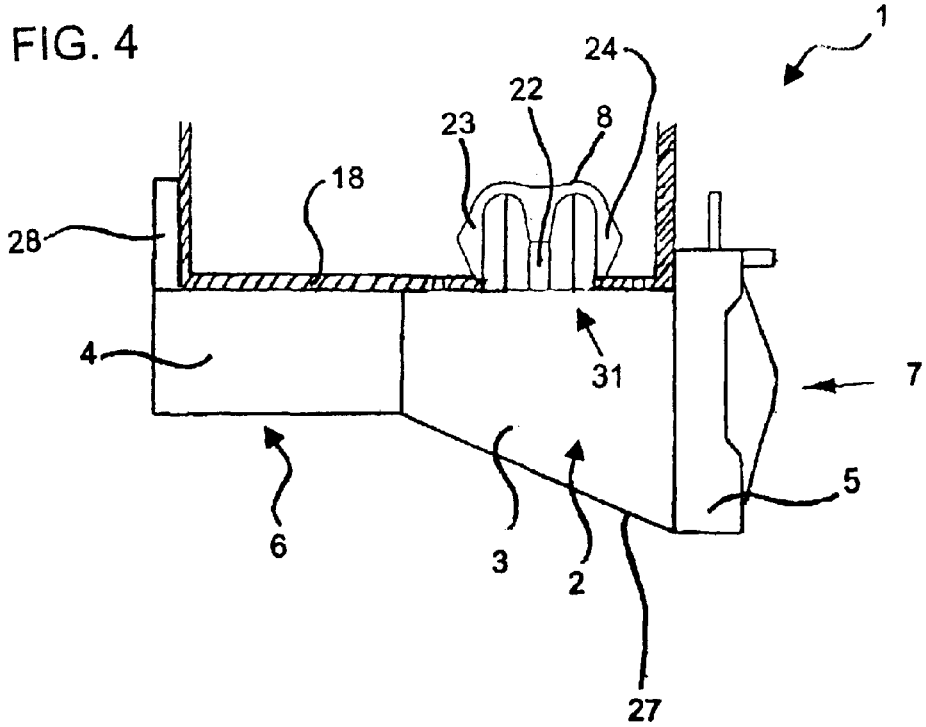
FIG. 4 is a partially plan and partially cross-sectional view of the adapter of FIG. 1 latched in a part of a washing machine.

FIG. 4 shows a plan view of an adapter 1 fitted on a part 18 of a washing machine. Fastening takes places in this embodiment in a manner similar to fastening in the second side portion 5. The fastening device 8 of the adapter 1 is pressed through the opening 31 in the part 18 of the washing machine by the two movable hooks 23, 24 being pressed together in the direction of the web 22. As soon as the hooks 23, 24 have moved through the opening 31, they spring back again into the non-loaded, starting position and, thus, latch on the inside of the part 18 of the washing machine. For the adapter to be better guided and stabilized on the washing-machine part 18, it is, additionally, possible to use a corresponding extension 28 at the outer end of the first side portion 4 and the rearwardly projecting part of the surface 20 of the second side portion 5, these enclosing the washing-machine part 18 laterally.

It is also possible for parts other than water level regulators to be fastened by the adapter of the present invention, provided the fastening devices are suitable for such a purpose. It is, likewise, conceivable to extend the present principle to accommodate three or more water level regulators or other parts.

We claim:

1. An adapter for fastening water level regulators on parts of washing machines, comprising:

a housing having:

a first side portion having a first accommodating portion defining a first opening for accommodating a fastening device of a first water level regulator;

a second side portion having a second accommodating portion defining a second opening for accommodating a fastening device of a second water level regulator, said first opening in said first accommodating portion being disposed substantially perpendicular to said second opening in said second accommodating portion;

a central portion bounded by said first and second side portions; and a fastening device disposed in said central portion for fastening said housing on at least one part of a washing machine.

2. The adapter according to claim 1, wherein said fastening device is disposed to position a movement direction for firmly clamping said housing substantially the same as a movement direction for firmly clamping a water level regulator in said first accommodating portion.

3. The adapter according to claim 1, wherein said fastening device is disposed to position a movement direction for firmly clamping said housing on the part of the washing machine substantially the same as a movement direction for firmly clamping a water level regulator in said first accommodating portion.

4. The adapter according to claim 1, wherein:

said first accommodating portion has a top end, a bottom end, and a height; and said first opening in said first accommodating portion: extends approximately over entirety of said height; and is wider in a direction of said top end than in a direction of said bottom end.

5. The adapter according to claim 1, wherein:

said first accommodating portion has a top end, a bottom end, and a height; and said first opening in said first accommodating portion: extends over a portion of said height; and at least partially narrows in a direction from said top end to said bottom end.

6. The adapter according to claim 1, wherein said first accommodating portion has:

a top end; and a resilient tongue fastened adjacent to said top end at a distance behind said first opening.

7. The adapter according to claim 1, wherein said first accommodating portion has:

a top end, a bottom end, and an inside surface; and a resilient tongue fastened to said inside surface closer to said top end than said bottom end and extending to a distance from said inside surface toward said first opening and at a distance away from said first opening.

8. The adapter according to claim 1, wherein said second accommodating portion has outer borders and guide webs disposed at least on a portion of said outer borders for fixing the second water level regulator in a position at said second accommodating portion.

9. The adapter according to claim 1, wherein said second accommodating portion has outer borders and guide webs disposed at least on a portion of said outer borders for aligning the second water level regulator in a position at said second accommodating portion.

10. The adapter according to claim 1, wherein said central portion has a cavity for accommodating a fastening device of the second water level regulator introduced through said second opening of said second accommodating portion.

11. The adapter according to claim 1, wherein said housing is a one piece housing.

12. The adapter according to claim 1, wherein said housing, said first side portion, said second side portion, said central portion, and said fastening device are integral.

13. The adapter according to claim 1, wherein said housing, said first side portion, said second side portion, said central portion, and said fastening device are formed in one piece.

14. An adapter for fastening water level regulators on parts of washing machines, comprising:

a one-piece housing having:

a first side portion having a first accommodating portion defining a first opening for accommodating a fastening device of a first water level regulator, said first accommodating portion having a top end, a bottom end, a height, and a resilient tongue fastened adjacent to said top end at a distance from said first opening, said first opening extending over a portion of said height and at least partially narrowing in a direction from said top end to said bottom end;

a second side portion having a second accommodating portion defining a second opening for accommodating a fastening device of a second water level regulator, said first opening in said first accommodating portion being disposed substantially perpendicular to said second opening in said second accommodating portion, said second accommodating portion having outer borders and guide webs disposed at least on a portion of said outer borders for aligning the second water level regulator in a position at said second accommodating portion;

a central portion bounded by said first and second side portions and having a cavity for accommodating a fastening device of the second water level regulator introduced through said second opening; and a fastening device disposed in said central portion for fastening said housing on at least one part of a washing machine.

* * * * *